US010008770B2

(12) United States Patent
Cherubini et al.

(10) Patent No.: US 10,008,770 B2
(45) Date of Patent: Jun. 26, 2018

(54) BLIND CALIBRATION OF SENSORS OF SENSOR ARRAYS

(71) Applicant: International Business Machines Corporation, Armonk, NY (US)

(72) Inventors: Giovanni Cherubini, Zurich (CH); Paul T. Hurley, Oberrieden (CH); Sanaz Kazemi, Barcelona (ES); Matthieu M. Simeoni, Zurich (CH)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 286 days.

(21) Appl. No.: 14/945,647

(22) Filed: Nov. 19, 2015

(65) Prior Publication Data

US 2017/0149132 A1 May 25, 2017

(51) Int. Cl.
*H01Q 3/00* (2006.01)
*H01Q 3/26* (2006.01)

(52) U.S. Cl.
CPC ..... *H01Q 3/267* (2013.01)

(58) Field of Classification Search
CPC ..... H01Q 3/40; H01Q 3/267
USPC ..... 342/81, 154, 174, 372, 373; 367/103
See application file for complete search history.

(56) References Cited

U.S. PATENT DOCUMENTS

2003/0071750 A1* 4/2003 Benitz ..... G01S 13/9011 342/25 R
2007/0159922 A1* 7/2007 Zimmerman ..... G01S 7/52004 367/103

OTHER PUBLICATIONS

S. Kazemi, et al., "Blind calibration for radio interferometry using convex optimization," Proc. 3rd Int'l Workshop on Compressed Sensing Theory and its Applications to Radar, Sonar and Remote Sensing, CoSeRa 2015, Pisa, Italy, Jun. 2015, p. 1-5.

* cited by examiner

*Primary Examiner* — Dao L Phan
(74) *Attorney, Agent, or Firm* — Cantor Colburn LLP

(57) ABSTRACT

Embodiments include methods for calibrating sensors of one or more sensor arrays. Aspects include accessing one or more beamforming matrices respectively associated to the one or more sensor arrays. Source intensity estimates are obtained for a set of points in a region of interest, based on measurement values as obtained after beamforming signals from the one or more sensor arrays based on the one or more beamforming matrices, assuming fixed amplitude and phase of gains of sensors of the one or more sensor arrays. Estimates of amplitude and phase of the sensor gains are obtained based on: measurement values as obtained before beamforming; and the previously obtained source intensity estimates. The obtained estimates of amplitude and phase can be used for calibrating sensors.

20 Claims, 6 Drawing Sheets

BLIND CALIBRATION OF SENSORS OF SENSOR ARRAYS

BACKGROUND

The invention relates in general to the field of computerized methods for performing blind calibration of sensor arrays, where signals from such arrays are subject to beamforming, in particular in the fields of radio interferometry (to recover a sky image), magnetic resonance imaging or ultrasound imaging.

Image reconstruction from signals received by sensor arrays is used in many application fields, including radio interferometry for astronomical investigations, and magnetic resonance imaging, ultrasound imaging, and positron emission tomography for medical applications.

For example, modern large-scale radio telescope arrays use antenna stations composed of multiple antennas that are closely placed for imaging the sky. The signals received by the antennas at a station are combined by beamforming to reduce the amount of data to be processed in the later stages. Currently, beamforming at antenna stations is typically done by conjugate matched beamforming towards the center of the field of view at all antenna stations. The signals transmitted by the stations are then correlated to obtain measurement values called visibilities, which roughly correspond to the samples of the Fourier transform of the sky image. The reconstruction of the sky image is thus obtained from methods based on the inverse Fourier transform of the entire collection of visibility measurements.

The instruments for the above applications often have a hierarchical system architecture in the sense that they are phased-arrays of several smaller phased-arrays (groups of compact sensor elements acting as receivers) called stations (or subarrays). Consequently, beamforming techniques adopted within these instruments may also follow the same hierarchy, performed initially for individual stations, and later on for the whole instrument. A suitable station calibration prior to beamforming allows for better exploitation of the instrument. This calibration estimates amplitude adjustment and phase shift compensation parameters for each individual sensor gain, correcting for system losses and delays in station measurements. The most popular methods are of the supervised variety: they rely on known properties of known sources to estimate instrumental unknown parameters. However, such methods have two main drawbacks: (a) prior information about the region of interest is available only for strong sources, which leads to loss in performance because weak sources are disregarded, and (b) performance is sensitive to the accuracy of strong source data.

In addition, blind calibration methods exist, that is, unsupervised methods, where calibration works without resorting to known sources, such that the above difficulties are circumvented. Two types of blind calibration approaches are known. The first approach, called redundancy calibration, makes explicit use of redundant baselines (those baselines having same length and orientation), to repeatedly observe the same resultant Fourier sample of the region of interest. With sufficient groups of redundant baselines, the sensor element gains can be estimated more accurately and faster than with supervised calibration methods. Such a scheme, however, requires deploying sensor elements that are entirely devoted to this task, rather than using them for further baselines. The second blind calibration approach uses convex optimization or message passing algorithms and relies on the fact that, at the low signal to noise ratio (SNR) levels that are typically found in station observations, there are only a few strong sources detectable, with weaker ones buried in the noise. Consequently, the sources can be assumed to be sparse and blind station calibration can be formulated as a general sparsity problem, which aims to estimate signals along with associated instrumental amplitude and phase distortions.

SUMMARY

According to a first aspect, the present invention is embodied as a computer-implemented method for calibrating sensors of one or more sensor arrays. The method first comprises: accessing one or more beamforming matrices respectively associated to the one or more sensor arrays. Next, on the one hand, source intensity estimates are obtained for a set of points in a region of interest, based on (i) measurement values as obtained after beamforming signals from the one or more sensor arrays (based on the one or more beamforming matrices), and assuming (ii) fixed amplitude and phase of gains of the sensors. On the other hand, estimates of amplitude and phase of the sensor gains are obtained, based on: (i) measurement values as obtained before beamforming signals from the one or more sensor arrays; and (ii) the previously obtained source intensity estimates. Finally, the obtained estimates of amplitude and phase can be used for calibrating the sensor arrays. The steps of accessing the beamforming matrices and obtaining the estimates are performed via a processing element, i.e., one or more processors, processor cores or, more generally, via a computerized system.

Typically, the steps of obtaining the intensity estimates and the estimates of amplitude and phase are iterated over short-term integration intervals and, possibly, even within a same short-term integration interval. In addition, such steps may further be iterated over distinct selected subsets of points in the region of interest. Estimates are obtained according to a message passing method in a bipartite factor graph.

BRIEF DESCRIPTION OF THE DRAWINGS

The accompanying drawings show simplified representations of devices or parts thereof, as involved in embodiments. Similar or functionally similar elements in the figures have been allocated the same numeral references, unless otherwise indicated.

DETAILED DESCRIPTION OF EMBODIMENTS OF THE INVENTION

As it can be realized, the computational complexity of the second type of blind calibration methods discussed in the introduction increases with the integration time, i.e., the number of samples in the sequences that represent the measurements at the sensor elements. Therefore, this approach presents the challenge that, for a large region of interest and in a low SNR environment, the integration time should ideally be as large as possible, leading to an exceedingly large complexity.

Therefore, present inventors have developed blind calibration methods of reduced computational complexity, which are now discussed in detail. The following description is structured as follows. First, general embodiments and high-level variants are described (sect. 1). Then, more specific embodiments and technical implementation details are addressed (sect. 2 and 3).

Figure 1:
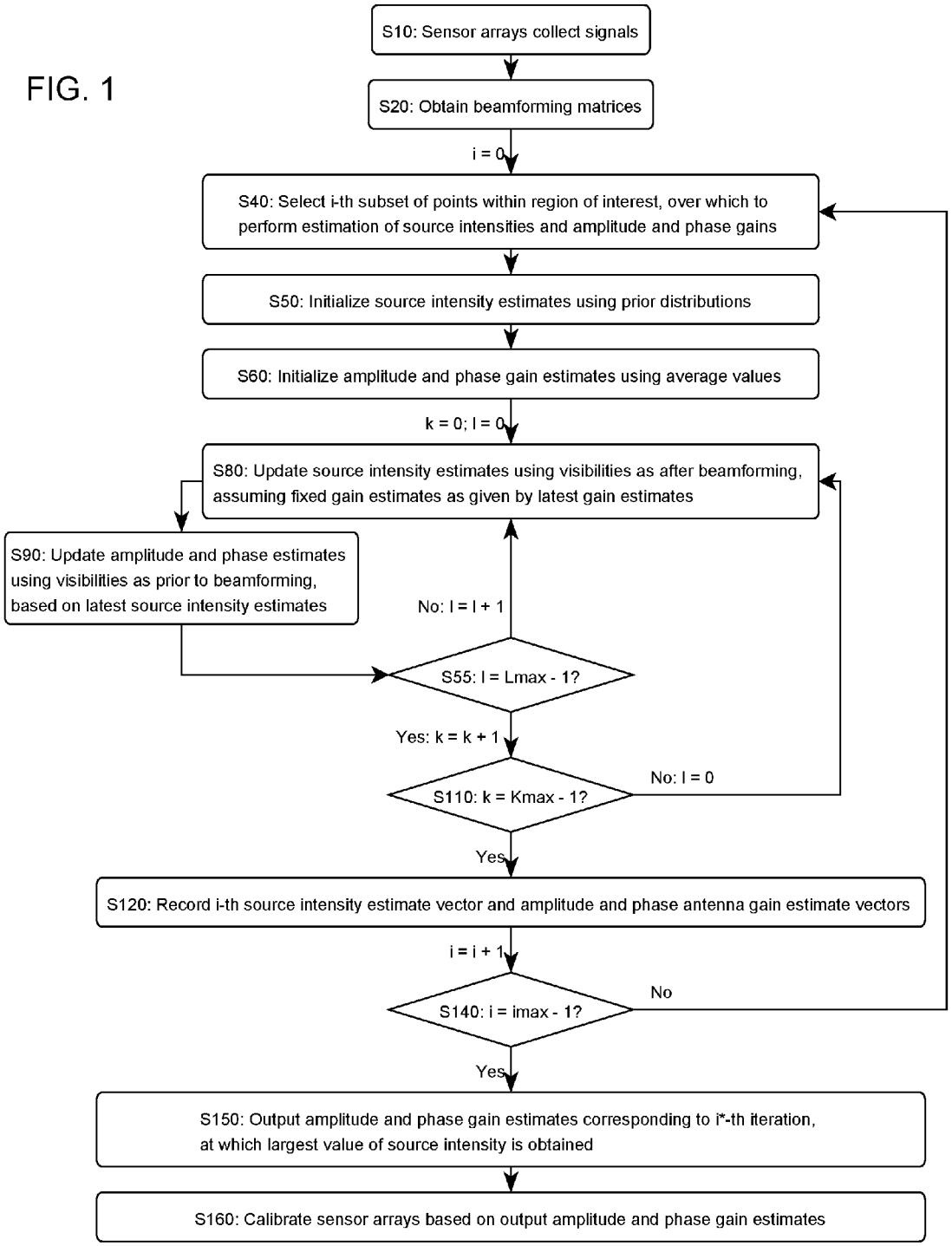
FIG. 1 is a flowchart illustrating high-level steps of a blind calibration method, according to embodiments of the invention.
Figure 3:
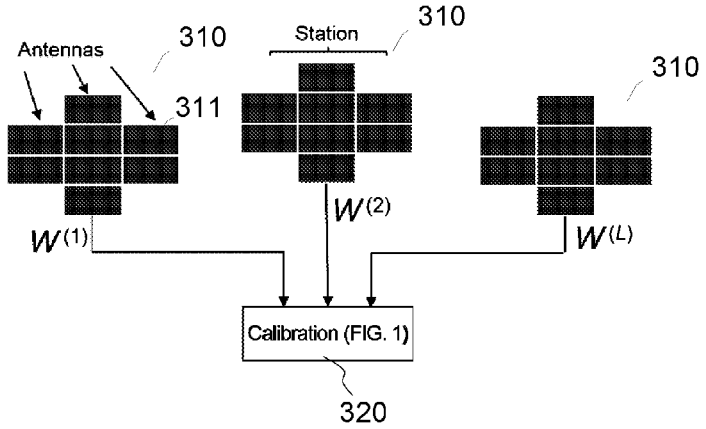
FIG. 3 is a block diagram schematically illustrating selected components of a radio interferometry system (a radio interferometer with stations and beamforming matrices), as involved in embodiments.
Figure 4:
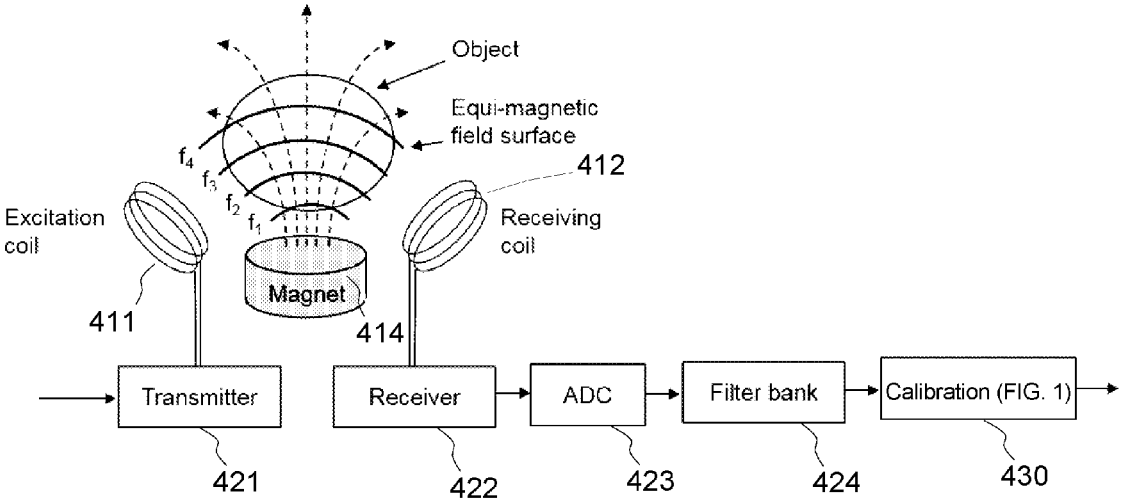
FIG. 4 is a block diagram schematically illustrating selected components of a magnetic resonance imaging (MRI) system, as involved in embodiments.

In reference to FIGS. 1, 3 and 4, an aspect of the invention is first described, which concerns computer-implemented methods for calibrating sensors of one or more sensor arrays. Present sensors may notably include antennas (as in FIG. 3) and MRI coils (as in FIG. 4). Sensor arrays are denoted by references 310 in FIG. 3, where an array corresponds to an antenna station and sensors to antennas, denoted by reference 312. Sensors are denoted by reference 412 in FIG. 4 (MRI system).

The present methods basically rely on beamforming matrices that are respectively associated to sensor arrays (beamforming is assumed in the present context). Beamforming matrices are accessed at step S20, FIG. 1. The beamforming matrices are formed by sensor steering vectors of the sensor arrays. The steering vectors may be considered constant within a short-term integration (STI) interval, as assumed in the present case. They are otherwise assumed to be time varying, in general.

In variants, beamformed signals may be generated directly from the arrays of receiving elements, without resorting to antenna steering vectors, e.g., by randomizing beamforming matrices (the concept of beamformed signals from randomized beamforming matrices is known per se).

Next, present methods essentially seek to successively obtain S80-S90: on the one hand, source intensity estimates S80 and, on the other hand, estimates of amplitude and phase S90 of the sensor gains.

Source intensity estimates are obtained S80 for a set of points in a region of interest and based on measurement values (also called visibilities in the field of radio interferometry) as obtained after beamforming signals from the sensor arrays. This operation makes use of the previously accessed S20 beamforming matrices, as explained later in detail. In addition, the source intensity estimates are obtained S80 assuming fixed gains (amplitude and phase) of the sensors. I.e., the model used to estimate the source intensities assumes fixed amplitudes and phases.

On the contrary, estimates of amplitude and phase of the sensor gains are obtained, step S90, based on measurement values as obtained before beamforming (i.e., without involving beamforming matrices at all) and the obtained S80 source intensity estimates. Estimates for amplitude and phase may be aggregated in gain estimates, where the gain is formulated as a complex number, capturing both the amplitude and the phase values, as known per se. The estimates for amplitude and phase may else be computed separately.

Finally, the obtained estimates of amplitude and phase can be used S160 for calibrating sensors of the sensor arrays. Each sensor of the arrays may benefit from such a calibration. I.e., each of the sensors will be calibrated based on the obtained estimates of amplitude and phase. Sensor calibration is known per se.

The source intensities can, most generally, be expressed as a function of the amplitude and phase of the sensor gains. However, instead of computing gain-dependent source intensities, the present approach assumes values of amplitudes and phases of the sensor gains that remain constant over the interval during which the source intensities are estimated. Thus, the values of the amplitude and phase of the sensor gains need be fixed, prior to compute S80 the source intensities. Now, the values of the amplitude and phase of the sensor gains are subsequently estimated S90 using, this time, the previously obtained source intensities as input. Assuming sufficiently short intervals, the above process, which entails moderate computational efforts as opposed to known blind calibration methods, will quickly converge.

Convergence may already be obtained after one iteration only, e.g., during or corresponding to one STI interval. If not, the process can be iterated, to eventually obtain amplitudes and phases of the sensor gains, which are then used to calibrate the sensor arrays, as explained below.

The steps of accessing the beamforming matrices and obtaining the estimates are performed via a processing element, i.e., one or more processors, processor cores or, more generally, via a computerized system, as explained later in reference to FIG. 8.

In exemplary embodiments, the steps S80-S90 are iterated over STI intervals, and in some embodiments within a same STI interval. In addition, such steps may further be iterated over distinct selected subsets of points, as explained below in reference to FIG. 1, to further ease computation. Estimates are obtained according to a message passing method in a bipartite factor graph, as explained later in reference to FIG. 2.

The iteration process is now explained in detail, in reference to FIG. 1. As evoked above, the steps S80-S90 are iterated within a same STI interval, see step S55 in FIG. 1. I.e., intensity estimates S80 as obtained at any iteration l are updated based on estimates of amplitude and phase of the sensor gains as obtained at a previous iteration l−1 ($0<l<L_{max}$). This iteration may typically need between 2 and 32 iterations to converge ($L_{max}$ is typically chosen to be between 2 and 32 or between 8 and 32). Still, as the computational effort required for one iteration S80-S90 is moderate, the process can be tractably iterated, even during a single STI.

As reflected in the flowchart of FIG. 1, the above process may further be iterated S110 over STI intervals ($K_{max}$ STI intervals are assumed). I.e., at an iteration k ($1\leq k\leq K_{max}-1$), source intensity estimates are updated S80 based on the latest estimates of amplitude and phase, as obtained during an iteration k (if several iterations 1 are assumed within a same STI, [$L_{max}$>1]) or at the end of iteration k−1 (if only one intra-STI iteration is assumed). Estimates of amplitude and phase can, in all cases, be subsequently updated S90 based on the latest source intensity estimates obtained during iteration k.

Prior to a very first iteration (k=0, 1=0), the source intensity estimates need to be suitably initialized S50, e.g., based on prior probability distributions of amplitude and phase of the sensor gains and prior probability distributions of source intensities. For example, mean values may be used. In variants, one may generate values whose distribution is constrained according to such prior probability distributions. Estimates of amplitude and phase may be similarly initialized S60.

The above process S80-S90 can further be limited to a selected subset of points in the region of interest, to further lower the computational efforts, if needed. Yet, the process may be iterated S40-S140 over distinct, selected subsets of points. In that case, for each subset i of points selected at an $i^{th}$ iteration i, $0 \le i \le i_{max}-1$, the steps S80-S90 of obtaining the intensity estimates and the estimates of amplitude and phase can be tractably iterated over $K_{max}$ STI intervals. In addition, steps S80-S90 can be iterated (over $L_{max}$ iterations) during a single STI, as explained above and as illustrated in FIG. 1.

The source intensity estimates and the estimates of amplitude and phase as obtained at the end of each iteration i (i.e., for each selected subset i of points) shall eventually be stored (or forwarded to a remote server for further processing). The stored intensity, amplitude and phase estimates are the values as obtained at a last one of the $K_{max}$ iterations (and at a last one of the $L_{max}$ iterations in the embodiment of FIG. 1).

In embodiments, one may subsequently seek to identify, among the stored values, estimates of amplitude and phase corresponding to the subset i* of points ($0 \le i^* \le i_{max}-1$) for which the largest value of source intensity was obtained, i.e., for which a best SNR, as estimated after image reconstruction within a subset of points, is obtained. The identified estimates of amplitude and phase can then be used S160 for calibrating the sensor arrays. In variants, one may not want to explore each subset i of points and intermediate recalibration steps may already intervene upon completing an iteration over a given subset i** of points. In other variants, the selection of a subset i of points may take into account the estimation results obtained at the previous i−1 iterations.

Figure 2:
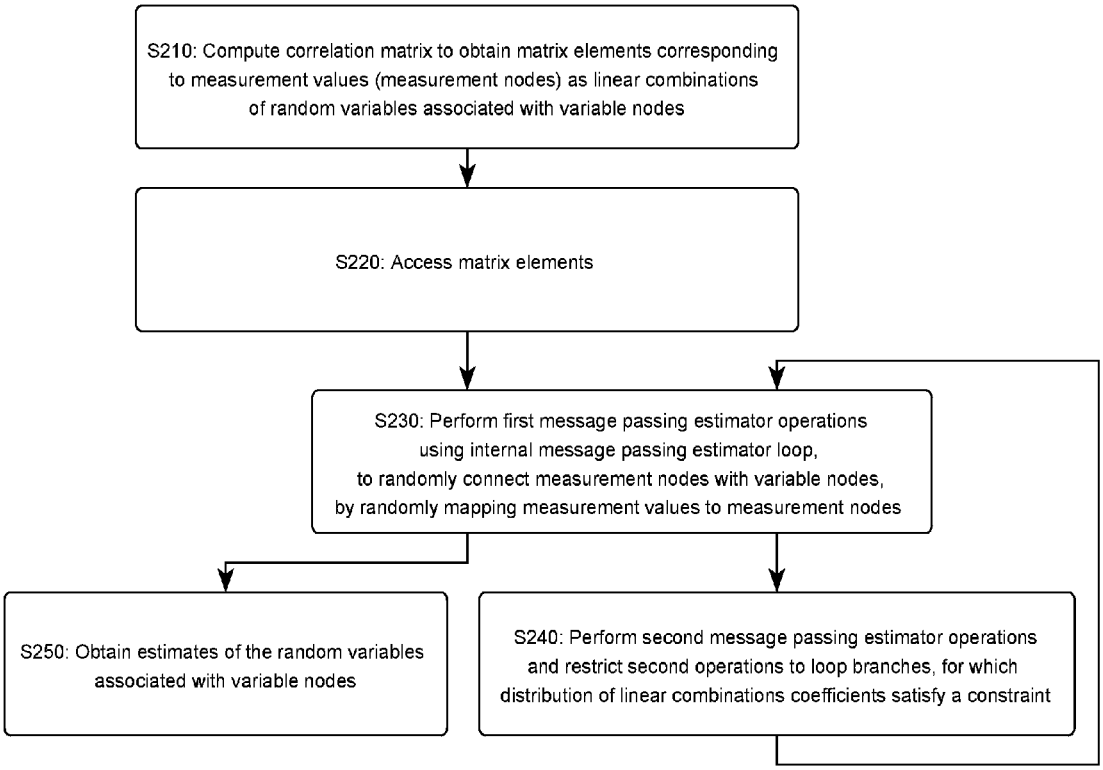
FIG. 2 is a flowchart illustrating message passing estimator operations to obtain estimates of random variables associated with variable nodes, according to a message passing method in a bipartite factor graph, as involved in embodiments of the invention.
Figure 5A:
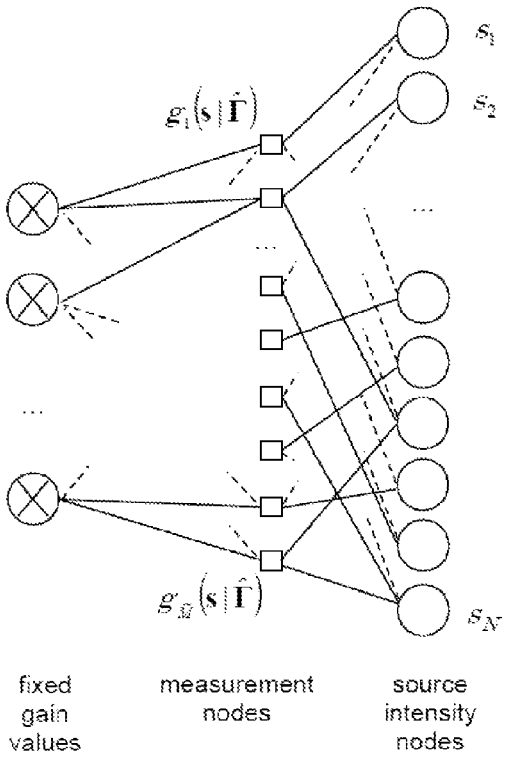
FIGS. 5A and 5B illustrate factor graph representations of the system model for the estimation of: source intensities sensor gains (amplitude and phase of the sensor gains.
Figure 5B:
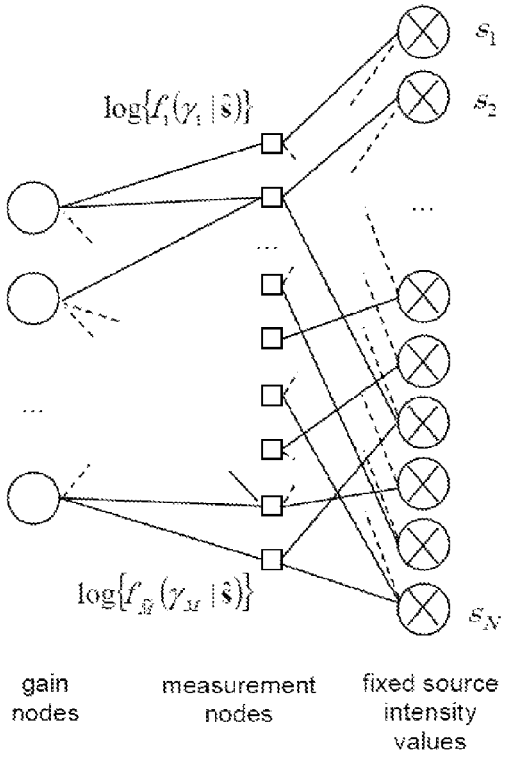

At present, the computations involved at steps S80 and S90 are explained in more details. Referring more particularly to FIGS. 2, 5A and 5B, the source intensity estimates may be obtained according to message passing methods in a bipartite factor graph, preferably approximate message passing (AMP) methods. Such methods are computer-implemented, i.e., performed by a processing element. Approximate message passing (AMP) algorithms are known, which efficiently implement sum-product, loopy belief propagation (LBP) algorithms. AMP algorithms exhibit very low computational complexity and have the remarkable property that their solutions are governed by a state evolution whose fixed points (when unique) yield the true posterior means, in certain circumstances.

Namely, and for each of the sensor arrays, matrix elements may be accessed S220, which respectively correspond to measurement values (e.g., visibilities). The latter can be respectively mapped to measurement nodes. The elements accessed are matrix elements of a correlation matrix as obtained S210 from a beamforming matrix respectively associated to a particular sensor array. Then, message passing estimator operations shall be performed S230-S240 to obtain estimates of random variables (representing the source intensities) that are associated with variable nodes, according to the message passing method.

In this message passing method, the measurement values are, each, expressed as a term that comprises linear combinations of the random variables. However, the measurement values may, each, be expressed as a term that comprises a noise term (e.g., the noise terms are modeled as independent and identically distributed [i.i.d.] Gaussian random variables), besides a linear combination of random variables, for reasons that will become apparent later.

In addition, each message exchanged between any of the measurement nodes and any of the variable nodes is parameterized by parameters of a distribution of the random variables. In that respect, the method of message passing used is an approximate method.

In embodiments, measurement values may be randomly mapped S230 to the measurement nodes, when performing the message passing estimator operations. This random mapping is carried out at one or more iterations of the message passing method. As explained below, this allows to markedly improve the convergence of the method.

The above method uses a method of message passing in bipartite factor graphs (see FIGS. 5A and 5B), whereby information messages are exchanged, e.g., between N source intensities associated with variable nodes and $\tilde{M}$ measurement nodes (also called function nodes, corresponding to the so-called visibilities in radio interferometry). As known from message passing in bipartite factor graphs, a message sent by a variable node along a given edge is proportional to the product of incoming messages on all other edges, whereas a message sent by a measurement node along a given edge is proportional to the integral of the product of the node's constraint function and the incoming messages on all other edges. The integration is performed over all variables other than the one directly connected to the edge along which the message travels.

Because each message exchanged between any of the measurement nodes and any of the variable nodes is parameterized by parameters of the distribution of the random variables, the method of message passing used is only approximate, which, however, allows to speed up the calculations.

The random variables associated with the variable nodes may for instance be either zero or Rayleigh distributed with a given probability (sparse point sources assumption). The measurement nodes may notably be Gaussian for given point source realization, antenna steering vectors, and beamforming matrices (noisy correlation measurements affected by additive white Gaussian noise [AWGN]).

Ideally, a message passing method such as used herein would require an infinite numbers of measurement values and variables to guarantee convergence to the desired solution. This, however, is impossible in practice. Thus, a random mapping is introduced at step S230, which aims at reproducing the results obtained by a larger set of measurements and, therefore, artificially helps to achieve convergence to proper values. In that respect, this random mapping is performed at each iteration of the message passing method, to accelerate convergence.

Several distributions can be contemplated, depending on the case. For a large number of values, the combined effects of the messages from the variables at the measurement nodes can be approximated as Gaussian using central-limit theorem arguments. Each message from a measurement node to a variable node is also typically Gaussian, with mean and variance readily obtained from the parameters of the incoming messages and of the measurement node. Therefore it is sufficient to parameterize each message by its mean and variance only.

Other distributions can nevertheless be contemplated, in specific cases. Still, functions are typically well behaved, bell-shaped function. A distribution that is an approximation of a Gaussian may typically convene for the present purpose. However, approximate message passing methods mostly assume an ideal Gaussian distribution on the messages being exchanged.

Assuming a well-defined distribution of variables (such as Gaussian), each message exchanged may further be parameterized by at least one of the mean and the variance of this distribution. It is, however, sufficient to parameterize each message, which approximates a Gaussian random variable, by its mean and variance only, as a Gaussian random variable is univocally determined by its mean and variance. A further simplifying assumption that can be made is that the messages from the variable nodes to a measurement node have the same variance.

At each STI interval the correlation measurements may be "refreshed" with new values, if necessary. E.g., computing the mean values may need to take into account a variation with time of the antenna steering vectors. The source intensities at a discrete set of points can be estimated over a certain STI interval as a result of approximate message passing, and the new estimates used as priors for the subsequent estimation of amplitudes and phases of the sensor gains.

The step S90 (to estimate amplitudes and phases of the sensor gains) may advantageously use a similar AMP method as well. It may, however, also use more complex methods, as step S90 is not so intensive, from a computational complexity point of view, as step S80, since source intensity nodes, whose number is typically much larger than the number of sensor nodes, are fixed (FIG. 5B).

In addition to the random mapping, other aspects can be optimized to further improve the algorithm convergence, in embodiments, as explained now in reference to FIG. 2. Such optimization will be especially advantageous when applied to step S80. Namely, the message passing estimator operations can be decomposed into two groups of operations. During first message passing estimator operations, the measurement values are randomly mapped S230 to the measurement nodes. In addition, messages passed from measurement nodes to variable nodes during second message passing estimator operations may be pruned S240, by forcing a distribution of coefficients of the linear combinations of the random variables to satisfy a constraint.

This way, each of the random mapping and pruning processes contributes to improve the convergence of the algorithm. This is notably the case when: (i) the number of measurement nodes $\tilde{M}$ and of variable nodes N are finite, which is always true in practice, and (ii) the coefficients of the linear combinations that relate the random variables associated with the variable nodes to the measurement values, also referred to as graph coefficients, are not i.i.d. Gaussian. However, the additional pruning step may not be needed when the graph coefficients are i.i.d. Gaussian or approximate a Gaussian distribution.

Pruning the messages may result in restricting S240 the second message passing estimator operations to loop branches, for which the distribution of the coefficients of the linear combinations satisfies said given constraint.

In embodiments, steps S230 and S240 are iteratively performed. I.e., the first message passing estimator operations are performed S230, followed by second message passing estimator operations S240. Then, the method loops back to step S230, such that first message passing estimator operations are again performed S230, whereby measurement values are again randomly mapped S230 to the measurement nodes. This makes it possible to iteratively refine estimates of the random variables associated with the variable nodes.

In FIG. 2, the elements accessed at step S220 are matrix elements of a correlation matrix as obtained S210 from beamformed signals, i.e., signals that have been generated using beamforming matrices formed, e.g., by sensor steering vectors.

Note that, in variants to the above AMP methods, other methods may be contemplated, be it for step S80 or step S90, in particular convex optimization methods relying on sparsity of the solution for step S80, such as Basis Pursuit (BP), Basis Pursuit De-Noising (BPDN), or LASSO (Least Absolute Shrinkage and Selection Operator), or least-squares methods for the solution of systems of equations for step S90.

Additional implementation details related to FIGS. 1 and 2, as well as specific embodiments and results obtainable in such embodiments are discussed in sect. 2.

Referring now to FIG. 3, in embodiments, the present methods can be applied to radio interferometry, for calibrating antenna elements, e.g., in view of reconstructing a sky image. Here, signals are received from arrays of antennas 311, the arrays corresponding to antenna stations 310. A calibration unit 320 may receive signal data from the arrays 310 and perform steps S20-S160 as illustrated in FIG. 1, which may include steps S210-S250 as involved at steps S80 and S90, in particular embodiments, as explained above.

Referring to FIG. 4, the present methods may, in other embodiments, be applied to beamformed signals received from radiofrequency coils 411-412 of a magnetic resonance imaging hardware 411-424. Here the arrays of receiving elements (sensors) correspond to sets of radiofrequency coils (only one such set is depicted in FIG. 4, for simplicity). In FIG. 4, a magnetic resonance (MR) transceiver 421-422 typically generates 421 wideband excitation signals that are sent to one or more excitation coils 411 in K consecutive measurement bursts, and processes signals received 422 after each burst from one or more receiving coils 412 to detect narrowband signals at the output of J subchannels of a filter bank 424, after analog-to-digital conversion 423. The position of the magnet 414 is usually modified after each measurement to differentiate the spectral contributions to the received signal from each volume element.

Similarly, the signals received may be signals from arrays of ultrasound sensors and the signal data collected may be used to calibrate the ultrasound sensors, e.g., in view of reconstructing an ultrasound image.

Next, and according to another aspect, the invention can be embodied as a computer program product for calibrating sensors of sensor arrays. This computer program product comprises a computer readable storage medium having program instructions embodied therewith. The program instructions will be executable by a computerized system (such as depicted in FIG. 8) to cause to implement steps such as described above in reference to FIGS. 1 and 2. This aspect of the invention is discussed in more details in sect. 2.

The above embodiments have been succinctly described in reference to the accompanying drawings and may accommodate a number of variants. Several combinations of the above features may be contemplated. Examples are given in the next section.

In the following, a method is presented for blind station calibration from signals received by sensor arrays. While this method can be applied to several application fields, including medical imaging and radio interferometry, application to station calibration in radio interferometry is considered, for the sake of exemplification. The method is based on the iterative scanning beamforming of a region of interest, where information is extracted by a message passing algorithm over a factor graph connecting source intensity nodes, measurement nodes, and nodes that represent the amplitude and phase of the sensor element gains, which need to be estimated. The measurements are given by the correlations of the sequences of signal samples obtained at the sensor elements. Hence the complexity of the method depends on the length of the sample sequences only through the computation of the correlations, leading to a substantial reduction in complexity with respect to approaches that perform parameter estimation over the entire sequence of signal samples. An additional aspect emphasized below concerns the conditioning of the coefficients for the adopted message passing algorithm, which is obtained by an operation equivalent to beamforming with a full-rank matrix. All or part of the beamformed signals can be sent to a central processor, where beamformed signals are collected from all the stations for imaging.

In practice, sensor element gains are not perfectly known. Assuming that gain estimation is performed within a STI interval including L sampling instants, the observation model can be formulated as $$X=\Gamma AS+\eta, \tag{1}$$

where $X=[x_1, \ldots, x_L]$ is an M×L measurement data vector, $\Gamma=\mathrm{diag}(\gamma)$ is an M×M diagonal matrix whose elements on the diagonal are complex values $\gamma_m=\xi_m\exp(j\vartheta_m)$, m=1, . . . , M, that express amplitude and phase distortion of the sensor elements, A is an M×N measurement matrix that depends on the system physical characteristics, $S=[\zeta_1, \ldots, \zeta_L]$ is a Q×L matrix, whose columns are complex vectors expressing the signals emitted by the Q sources in the region of interest, and $\eta$ is an M×L noise matrix, whose elements are modeled as additive white Gaussian noise. The dimension M corresponds to the number of sensor elements at the station. The region where the signal sources are located is usually defined as the field of view for 2D imaging or, more generally, as the region of interest.

Assume a radio interferometer with M antennas per station. The positions of the antennas at the station are denoted by $p_m$, m=1, . . . , M. The antennas receive narrow-band signals centered at the frequency $f_0$. The signal received at the station from a source $\zeta_q$ in a direction identified by the unit vector $r_q$ is expressed as $$x_q=\Gamma a(r_q)\zeta_q, \tag{2}$$

where $a(r_q)$ is the M×1 antenna array steering vector for the station and direction $r_q$, given by $$a(r_q)=\begin{pmatrix} e^{-j2\pi<p_1,r_q>} \\ \vdots \\ e^{-j2\pi<p_M,r_q>} \end{pmatrix}, \tag{3}$$

where <p,r> denotes the inner product between the vectors p and r. Assuming there are Q point sources in the sky, by expressing the signals emitted by the sources as a complex vector $\zeta_q$ with dimension Q×1, the overall signal received at the station is given by $$x=\Gamma A(r_q)\zeta_q+\eta, \tag{4}$$

where the matrix A with dimensions M×Q is formed by the column vectors $a(r_q)$, q=1, . . . Q, and $\eta$ denotes the noise vector.

Beamforming is performed as a linear transformation of the signal x by a beamforming matrix W, with dimensions M×Ξ, where Ξ is the number of beamforms used at the station. In the following, a square M×M matrix W is assumed. The beamformer output is thus expressed as $$x_b=W^H x=W^H(\Gamma A\zeta_q+\eta), \tag{5}$$

where $W^H$ denotes the conjugate transpose of the matrix W. The expected value of the output of a correlator that receives the beamformed signals is given by $$R_W=W^H(\Gamma A\Sigma_s A^H\Gamma^H+\Sigma_\eta)W, \tag{6}$$

where, in the assumption of independent Gaussian sources and independent Gaussian antenna noise signals, the correlation matrix of the signals emitted by the sources $\Sigma_s$ is a Q×Q diagonal matrix, and the correlation matrix of the noise signals $\Sigma_\eta$ is an M×M diagonal matrix.

Each element in the correlation matrix $R_W$ can be expressed as a linear combination of the source intensities found in $\Sigma_s=\mathrm{diag}(\tilde{s}_1^2, \tilde{s}_2^2, \ldots, \tilde{s}_Q^2)=\mathrm{diag}(s)$, plus measurement noise arising from the antenna noise. In practice, an estimate of $R_W$ is obtained from a finite number of samples. Therefore an additional disturbance may be taken into account, which arises from the deviation from the ideal values of both the correlation matrix estimates $\hat{\Sigma}_s$ of the source intensities and $\hat{\Sigma}_\eta$ of the antenna noise signals. In the assumption of Gaussian signals, it turns out that the random correlation matrix estimates have a Wishart distribution, with a number of degrees of freedom equal to the number of samples used for the estimation of $R_W$.

As mentioned earlier, the method discussed here is based on the iterative scanning beamforming of the region of interest, which is subdivided into a collection of hypothetical intensity sources at arbitrary positions, corresponding to the points on a grid. For a single hypothetical source with unit intensity at the k-th point in the grid, i.e., $\tilde{s}_k^2=1$, and $\tilde{s}_j^2=0$ for j≠k, the signal received at the correlator output is given in the ideal case of absence of disturbances by equation (6), with $\Sigma_s=\mathrm{diag}(0, \ldots, 0, \tilde{s}_k^2=1, 0, \ldots, 0)$ and $\Sigma_\eta=0$. The antenna steering vectors forming the columns of the matrix A are computed by considering the N direction vectors $\{r\}_{n=1}^N$, which are defined by the points in the grid. After the received signals for all unitary hypothetical sources in the grid have been determined, and considering the Hermitian symmetry of the correlation matrix, the obtained responses are reshaped to form a matrix $V(\Gamma,W)$ of dimensions $\tilde{M}\times N$, where, in the assumption of M beamforms, $\tilde{M}=M(M+1)/2$, and N is the number of points in the grid in the region of interest. Recalling that in radio interferometry the correlation samples (visibilities), are collected over K short-term integration (STI) intervals, and that the antenna steering vectors may be considered constant within one STI, but are time varying in general, the observation model then is expressed as $$\begin{pmatrix} \rho_1 \\ \rho_2 \\ \vdots \\ \rho_K \end{pmatrix}=\begin{pmatrix} V_1(\Gamma, W) \\ V_2(\Gamma, W) \\ \vdots \\ V_K(\Gamma, W) \end{pmatrix}s+\begin{pmatrix} \tilde{\eta}_1 \\ \tilde{\eta}_2 \\ \vdots \\ \tilde{\eta}_K \end{pmatrix}, \tag{7}$$

where, for the k-th STI, $\rho_k$ denotes the vector of correlation samples, $V_k$ (Γ, W) is the matrix of responses of point sources with unit intensity that are located on the assumed grid in the region of interest, $\tilde{\eta}_k$ is the vector of augmented measurement noise terms, modeled as i.i.d. Gaussian random variables having zero mean and variance $\tilde{\sigma}^2$, and s is the vector of intensities of hypothetical sources that are located at the grid points of the region of interest. In embodiments, integration over one STI interval is assumed, so that equation (7) becomes $$\rho=V(\Gamma,W)s+\tilde{\eta}. \tag{8}$$

The expression (8) poses the problem of station calibration in a form amenable for the application of iterative scanning beamforming using an enhanced approximate message passing (AMP) algorithm such as described in sect. 1.

Let us then consider the application of a message passing algorithm to extract information about the hypothetical source intensities at the grid points and the antenna gains during a scanning iteration. The estimation of the source intensities and the antenna gains would ideally require to compute the posterior pdf $$p(s,\Gamma\mid p)\propto p(p\mid s,\Gamma)p(s,\Gamma)=\prod_{\ell=1}^{M}p(\gamma_\ell)\prod_{n=1}^{N}p(s_n)\prod_{m=1}^{\tilde{M}}p(\rho_m\mid s,\Gamma), \tag{9}$$

where $$p(\rho_m\mid s,\Gamma)\propto N(\rho_m;\,v_m(\Gamma,W)^Ts,\,\tilde{\sigma}^2), \tag{10}$$

and where N(x; μ, $\sigma^2$) denotes a Gaussian random variable with mean μ and variance $\sigma^2$, $v_m(\Gamma,W)^T$ is the m-th row of the matrix V(Γ,W), which depends on the antenna gains Γ and beamforming matrix W, and $p(\gamma_l)$ and $p(s_n)$ denote the prior probability distributions of antenna gains and source intensities, respectively. The prior probability of the source intensities is assumed to have a Bernoulli-Log Normal distribution, that is, $$p(s_n)=\lambda G(s_n;\mu_s,\sigma_s^2)+(1-\lambda)\delta(s_n),\lambda>0, \tag{11}$$

with G(x; μ, $\sigma^2$) denoting a Log Normal distribution with mean μ and variance $\sigma^2$, whereas the amplitude and phase of the antenna gains are assumed to have a Log Normal distribution and a uniform distribution, that is $p(\|\gamma_l\|)=G(\|\gamma_l\|;\mu_\gamma,\sigma_\gamma^2)$ and $p(\angle\gamma_l)=U(\angle\gamma_l;-a_\gamma,a_\gamma)$, respectively.

The estimates $\hat{s}$ and $\hat{\Gamma}$ that minimize the mean-square error (MSE) of the source intensities and of the antenna gains are given by the means of the respective marginal distributions. A direct computation of these estimates, however, would hardly be tractable. Therefore, one resorts to approximate message passing algorithms over the factor graphs in FIGS. 5A and 5B that iteratively produce estimates $\hat{s}$ and $\hat{\Gamma}$. The crossed variable nodes in the two graphs indicate that the message passing algorithm is alternatively applied at the k-th iteration to (a) estimate the source intensities $\hat{s}_k$ while assuming the antenna gains known and given by the estimate $\hat{\Gamma}_{k-1}$ obtained at the previous iteration, and (b) estimate the antenna gains $\hat{\Gamma}_k$ while assuming the intensities known and given by the estimates $\hat{s}_k$ obtained at the last iteration. At the k-th iteration, the functions associated with the measurement nodes in the two graphs of FIGS. 5A and 5(*b*) are given by $$g_m(s\mid\hat{\Gamma})\propto N(\rho_m;v(\hat{\Gamma}=\hat{\Gamma}_{k-1},W=\tilde{W})^Ts,\tilde{\sigma}^2), \tag{12}$$

and $$f_m(\Gamma\mid\hat{s})\propto N(\rho_m;v(\Gamma,W=I)^T\hat{s}_k,\tilde{\sigma}^2), \tag{13}$$

respectively. At the first iteration over the graph of FIG. 5A, $\hat{\Gamma}_0$ is given by the mean amplitude and phase values of the antenna gains.

In the graph of FIG. 5A, the variable nodes representing the source intensities are fully connected with the measurement nodes. The enhanced AMP discussed in sect. 1 is therefore applicable, which includes the following two key features.

Randomization. The estimation error is mitigated by introducing a random permutation of the function nodes at the end of each iteration of the AMP algorithm (step S230, FIG. 2).

Pruning. Only a subset of the messages from the measurement nodes to the variable nodes in the fully connected factor graph is allowed, which corresponds to a pruning of the messages, S240. The beamforming matrix $\tilde{W}$ is thus chosen so that the distribution of the coefficients of the matrix $V(\hat{\Gamma}=\hat{\Gamma}_0,\ W=\tilde{W})$, which correspond to the allowed connections in the factor graph, is approximately Gaussian.

In the graph of FIG. 5B, the variable nodes representing the antenna gains are sparsely connected with the measurement nodes, provided the correlation is computed prior to beamforming, that is W=I in (6). A standard message passing algorithm is therefore applicable, amongst other possible methods. The penalty represented by computing two correlations per STI interval is compensated by the simplification obtained in the factor graph, where each measurement depends on at most two antenna gains. Moreover, considering the logarithm of the measurements, as indicated in FIG. 5B, the gain amplitudes and phases can be expressed as linear functions, leading to a further simplification of the estimation algorithm. A flow chart describing the blind station calibration method is shown in FIG. 1.

Figure 6A:
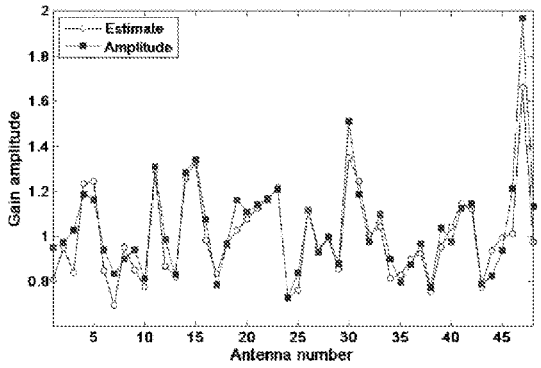
FIGS. 6A and 6B illustrate comparisons of actual and estimated amplitude of sensor gains, in a radio interferometry context, for a signal-to-noise ratio of −4.3 dB, where the estimated amplitude and phase were obtained according to embodiments.
Figure 6B:
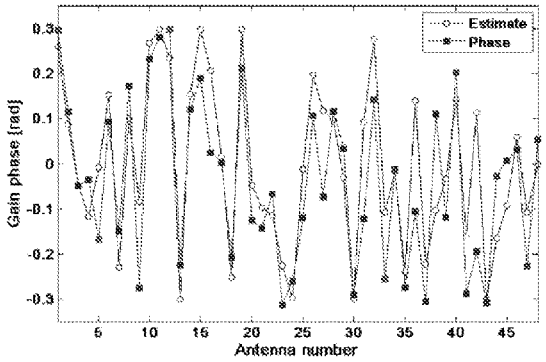
Figure 7A:
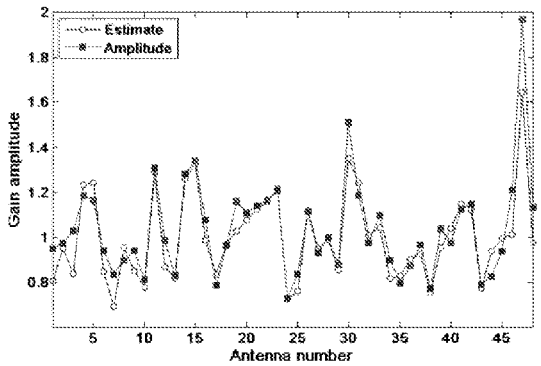
FIGS. 7A and 7B illustrate comparisons of actual and estimated amplitude of sensor gains, in a radio interferometry context, for a signal-to-noise ratio of −10.3 dB, where the estimated amplitude and phase were obtained according to embodiments.
Figure 7B:
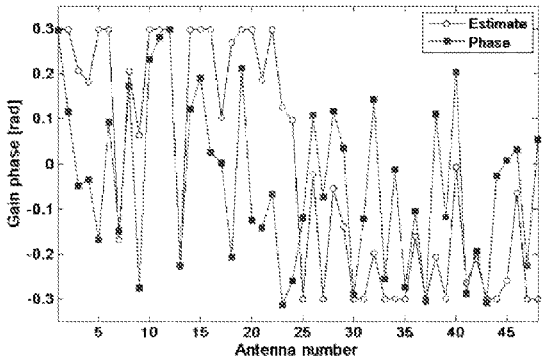

This blind station calibration method is illustrated by simulations of a radio interferometry antenna station having 48 antennas. The geographical distribution of the antennas corresponds to locations of antennas at a HBA (High-Band Antenna) station of an antenna array. The assumed radius of the field of view is 0.3 rad. In the field of view 3 point sources are located, with a total intensity of 3.75 Jy. Correlation of the received antenna signals is performed over 768 samples within an STI interval of 1 s. For the application of the present method (using iterative scanning beamforming), the field of view was subdivided into a collection of hypothetical intensity sources at arbitrary positions, defined over to 100 distinct 100-point subsets on a 100×100 grid. 256 iterations of the enhanced AMP algorithm over the factor graph of FIG. 5A and 64 iterations of the simplified message passing algorithm over the factor graph of FIG. 5B were performed at each 100-point subset. That is, one iteration over the factor graph of FIG. 5B was performed every four iterations over the factor graph of FIG. 5A. FIGS. 6 and 7 show the estimated amplitude and phase values of the antenna gains for SNR values of −4.3 dB and −10.3 dB, respectively, for prior distributions of the amplitude and phase of the antenna gains given by a Log Normal distribution $G(\|\gamma_l\|;\mu_\gamma=1,\sigma_\gamma^2=0.04)$ and a uniform distribution $U(\angle\gamma_l;-\pi/10,\pi/10)$, respectively, which represent typical parameter distributions. The results indicate that a robust and accurate estimation of the antenna gains is achieved.

Computerized devices can be suitably designed for implementing embodiments of the present invention as described herein. In that respect, it can be appreciated that the methods described herein are largely non-interactive and automated. In exemplary embodiments, the methods described herein can be implemented either in an interactive, partly-interactive or non-interactive system. The methods described herein can be implemented in software (e.g., firmware), hardware, or a combination thereof. In exemplary embodiments, the methods described herein are implemented in software, as an executable program, the latter executed by suitable digital processing devices. More generally, embodiments of the present invention can be implemented wherein general-purpose digital computers, such as personal computers, workstations, etc., are used.

Figure 8:
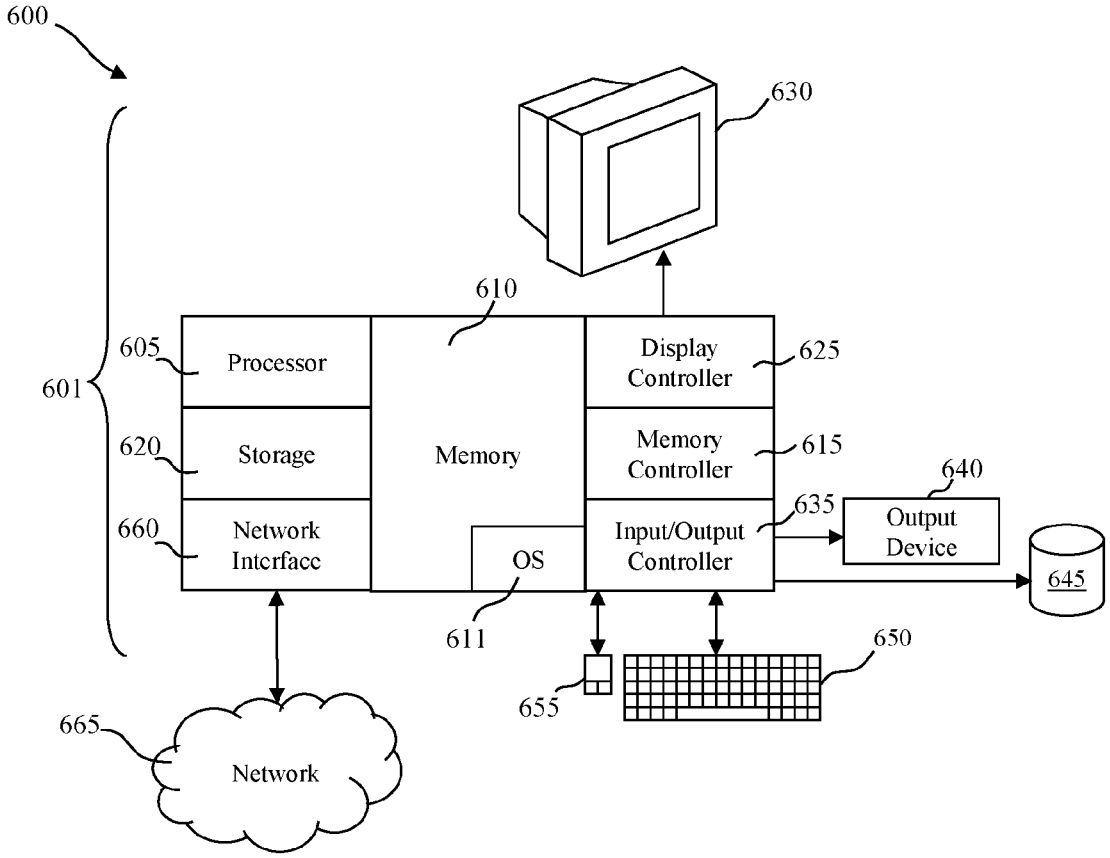
FIG. 8 schematically represents a general purpose computerized system, suited for implementing one or more method steps as involved in embodiments of the invention.

For instance, the system 600 depicted in FIG. 8 schematically represents a computerized unit 601, e.g., a general-purpose computer. In exemplary embodiments, in terms of hardware architecture, as shown in FIG. 8, the unit 601 includes a processor 605, memory 610 coupled to a memory controller 615, and one or more input and/or output (I/O) devices 640, 645, 650, 655 (or peripherals) that are communicatively coupled via a local input/output controller 635. The input/output controller 635 can be, but is not limited to, one or more buses or other wired or wireless connections, as is known in the art. The input/output controller 635 may have additional elements, which are omitted for simplicity, such as controllers, buffers (caches), drivers, repeaters, and receivers, to enable communications. Further, the local interface may include address, control, and/or data connections to enable appropriate communications among the aforementioned components.

The processor 605 is a hardware device for executing software, particularly that stored in memory 610. The processor 605 can be any custom made or commercially available processor, a central processing unit (CPU), an auxiliary processor among several processors associated with the computer 601, a semiconductor based microprocessor (in the form of a microchip or chip set), or generally any device for executing software instructions.

The memory 610 can include any one or combination of volatile memory elements (e.g., random access memory) and nonvolatile memory elements. Moreover, the memory 610 may incorporate electronic, magnetic, optical, and/or other types of storage media. Note that the memory 610 can have a distributed architecture, where various components are situated remote from one another, but can be accessed by the processor 605.

The software in memory 610 may include one or more separate programs, each of which comprises an ordered listing of executable instructions for implementing logical functions. In the example of FIG. 8, the software in the memory 610 includes methods described herein in accordance with exemplary embodiments and a suitable operating system (OS) 611. The OS 611 essentially controls the execution of other computer programs, and provides scheduling, input-output control, file and data management, memory management, and communication control and related services.

The methods described herein may be in the form of a source program, executable program (object code), script, or any other entity comprising a set of instructions to be performed. When in a source program form, then the program needs to be translated via a compiler, assembler, interpreter, or the like, as known per se, which may or may not be included within the memory 610, so as to operate properly in connection with the OS 611. Furthermore, the methods can be written as an object oriented programming language, which has classes of data and methods, or a procedure programming language, which has routines, subroutines, and/or functions.

Possibly, a conventional keyboard 650 and mouse 655 can be coupled to the input/output controller 635. Other I/O devices 640-655 may include other hardware devices. In addition, the I/O devices 640-655 may further include devices that communicate both inputs and outputs. The system 600 can further include a display controller 625 coupled to a display 630. In exemplary embodiments, the system 600 can further include a network interface or transceiver 660 for coupling to a network 665.

The network 665 transmits and receives data between the unit 601 and external systems. The network 665 is possibly implemented in a wireless fashion, e.g., using wireless protocols and technologies, such as WiFi, WiMax, etc. The network 665 may be a fixed wireless network, a wireless local area network (LAN), a wireless wide area network (WAN) a personal area network (PAN), a virtual private network (VPN), intranet or other suitable network system and includes equipment for receiving and transmitting signals.

The network 665 can also be an IP-based network for communication between the unit 601 and any external server, client and the like via a broadband connection. In exemplary embodiments, network 665 can be a managed IP network administered by a service provider. Besides, the network 665 can be a packet-switched network such as a LAN, WAN, Internet network, etc. If the unit 601 is a PC, workstation, intelligent device or the like, the software in the memory 610 may further include a basic input output system (BIOS). The BIOS is stored in ROM so that the BIOS can be executed when the computer 601 is activated.

When the unit 601 is in operation, the processor 605 is configured to execute software stored within the memory 610, to communicate data to and from the memory 610, and to generally control operations of the computer 601 pursuant to the software. The methods described herein and the OS 611, in whole or in part are read by the processor 605, typically buffered within the processor 605, and then executed. When the methods described herein are implemented in software, the methods can be stored on any computer readable medium, such as storage 620, for use by or in connection with any computer related system or method.

The present invention may be a method (e.g., implemented as a system) and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punchcards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the C programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the present invention has been described with reference to a limited number of embodiments, variants and the accompanying drawings, it will be understood by those skilled in the art that various changes may be made and equivalents may be substituted without departing from the scope of the present invention. In particular, a feature (device-like or method-like) recited in a given embodiment, variant or shown in a drawing may be combined with or replace another feature in another embodiment, variant or drawing, without departing from the scope of the present invention. Various combinations of the features described in respect of any of the above embodiments or variants may accordingly be contemplated, that remain within the scope of the appended claims. In addition, many minor modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims. In addition, many other variants than explicitly touched above can be contemplated.

What is claimed is:

1. A computer-implemented method for calibrating sensors of one or more sensor arrays, the method comprising:

accessing, via a processing element, one or more beamforming matrices respectively associated to the one or more sensor arrays;

obtaining, via a processing element:

source intensity estimates for a set of points in a region of interest, based on:

measurement values as obtained after beamforming signals from the one or more sensor arrays, based on the one or more beamforming matrices; and fixed amplitude and phase of gains of the sensors of the one or more sensor arrays; and estimates of amplitude and phase of the sensor gains, based on: measurement values as obtained before beamforming signals from the one or more sensor arrays; and the obtained source intensity estimates; and using the obtained estimates of amplitude and phase for calibrating said sensors.

2. The method of claim 1, further comprising: iterating, within a same short-term integration interval, obtaining the intensity estimates and obtaining the estimates of amplitude and phase, such that intensity estimates as obtained at any iteration l are updated based on estimates of amplitude and phase of sensor gains as obtained at a previous iteration l−1.

3. The method of claim 1, further comprising:

iterating obtaining the intensity estimates and estimates of amplitude and phase, over $K_{max}$ short-term integration intervals, such that, at an iteration k, $1 \le k \le K_{max}-1$:

source intensity estimates are updated based on latest estimates of amplitude and phase, as obtained during iteration k or k−1; and estimates of amplitude and phase are updated based on latest source intensity estimates as updated during iteration k.

4. The method of claim 3, further comprising, prior to a first iteration k=0, initializing the source intensity estimates based on prior probability distributions of amplitude and phase of the sensor gains and prior probability distributions of source intensities.

5. The method of claim 4, further comprising, prior to a first iteration k=0, initializing estimates of amplitude and phase based on prior probability distributions of amplitude and phase of the sensor gains and prior probability distributions of source intensities.

6. The method of claim 4, wherein said set of points is a selected subset of points in the region of interest.

7. The method of claim 6, wherein obtaining intensity estimates and obtaining estimates of amplitude and phase are further iterated over distinct selected subsets of points, in the region of interest such that, for each subset i of points selected at an iteration i, $0 \le i \le i_{max}-1$, the step of obtaining the intensity estimates and the estimates of amplitude and phase are iterated over $K_{max}$ short-term integration intervals.

8. The method of claim 7, further comprising, for each subset i of points selected at an iteration i, $0 \le i \le i_{max}-1$, storing the source intensity estimates and the estimates of amplitude and phase, as obtained at a last one of the iterations over the $K_{max}$ short-term integration intervals.

9. The method of claim 8, further comprising identifying estimates of amplitude and phase corresponding to a selected subset i* of points, $0 \le i^* \le i_{max}-1$, for which a largest value of source intensity was obtained, wherein such identified estimates of amplitude and phase are used for calibrating the sensor arrays.

10. The method of claim 1, wherein obtaining the source intensity estimates comprises:

for each of the one or more sensor arrays:

accessing, via a processing element, elements that respectively correspond to measurement values, which can be respectively mapped to measurement nodes, wherein the elements accessed are matrix elements of a correlation matrix obtained from a beamforming matrix respectively associated to said each sensor array; and performing, via a processing element, message passing estimator operations to obtain estimates of random variables representing source intensities that are associated with variable nodes, according to a message passing method in a bipartite factor graph, wherein:

the measurement values are, each, expressed as a term that comprises linear combinations of the random variables; and each message exchanged between any of the measurement nodes and any of the variable nodes is parameterized by parameters of a distribution of the random variables.

11. The method of claim 10, wherein performing the message passing estimator operations further comprises randomly mapping measurement values to the measurement nodes, at one or more iterations of the message passing method.

12. The method of claim 11, wherein performing message passing estimator operations comprises:

performing first message passing estimator operations, whereby said measurement values are randomly mapped to the measurement nodes; and performing second message passing estimator operations, wherein messages passed from measurement nodes to variable nodes are pruned, by forcing a distribution of coefficients of said linear combinations to satisfy a constraint.

13. The method of claim 12, wherein performing the second message passing estimator operations further comprises restricting the second message passing estimator operations to loop branches, for which the distribution of said coefficients satisfies said constraint.

14. The method of claim 10, wherein each message exchanged is parameterized by at least one of a mean and a variance of the distribution of the variables.

15. The method of claim 13, wherein each message exchanged is parameterized by the mean and the variance of the distribution of the variables.

16. The method of claim 15, wherein said distribution of the variables is a Gaussian distribution.

17. The method of claim 10, wherein the measurement values are, each, expressed as a term that comprises a linear combination of random variables and a noise term.

18. The method of claim 1, wherein the one or more sensor arrays are one or more antenna stations, respectively.

19. The method of claim 18, wherein the one or more sensor arrays are respectively one or more sets of radiofrequency coils of a magnetic resonance imaging hardware.

20. A computer program product for calibrating sensors of one or more sensor arrays, the computer program product comprising a computer readable storage medium having program instructions embodied therewith, the program instructions being executable by a computerized system to cause to:

access one or more beamforming matrices respectively associated to the one or more sensor arrays;

obtain:

source intensity estimates for a set of points in a region of interest, based on:

measurement values as obtained after beamforming signals from the one or more sensor arrays based on the one or more beamforming matrices; and fixed amplitude and phase of gains of sensors of the one or more sensor arrays; and estimates of amplitude and phase of the sensor gains, based on:

measurement values as obtained before beamforming; and the obtained source intensity estimates, such that the obtained estimates of amplitude and phase may be used for calibrating said sensors.

* * * * *